US005083579A

United States Patent [19]

Vanin et al.

[11] Patent Number: 5,083,579

[45] Date of Patent: Jan. 28, 1992

[54] COMPOSITION FOR ABSORBING NITROGEN OXIDE FROM TOBACCO SMOKE, METHOD FOR ABSORBING NITROGEN OXIDE USING SAID COMPOSITION, FILTER FOR PURIFYING TOBACCO SMOKE USING SAID COMPOSITION, AND METHOD FOR IMPREGNATING THE BASE OF A FILTER WITH SAID COMPOSITION

[76] Inventors: Anatoly F. Vanin, ulitsa Vvedenskogo, 13, korpus 2, kv. 274; Petr I. Mordvintsev, ulitsa marshala Fedorenko, 8, korpus 4, kv. 522; Ljudmila N. Kubrina, 2 Vladimirskaya ulitsa, 29, kv. 61, all of Moscow; Ilgam S. ogly Kurbanov, 9 mikroraion, ulitsa Verkhnaya Koltsevaya, 149, kv. 100, Baku; Elizar Y. Kaplan, Leninsky prospekt, 152, korpus 2, kv. 14; Leonid Y. Sinelnikov, ploschad Pobedy, 1, korpus B, kv. 220, both of Moscow, all of U.S.S.R.

[21] Appl. No.: 380,147

[22] Filed: Jul. 14, 1989

[30] Foreign Application Priority Data

Jul. 15, 1988 [SU] U.S.S.R. ..... 4462273

[51] Int. Cl.[5] ..... A24D 3/06; A24D 3/08; A24D 3/10; A24D 3/12

[52] U.S. Cl. ..... 131/334; 131/341; 131/342; 131/345

[58] Field of Search ..... 131/331, 332, 33, 34, 131/341, 342, 344, 345

[56] References Cited

FOREIGN PATENT DOCUMENTS 3624145 7/1987 Fed. Rep. of Germany .
1180053 9/1985 U.S.S.R. .
2009722 6/1979 United Kingdom .
2035980 6/1980 United Kingdom .
2150806 5/1983 United Kingdom .
2150806 11/1983 United Kingdom .

OTHER PUBLICATIONS

Hoffman D. Hecht S. P.: Cancer Research, vol. 45, pp. 935–944, 1985.
Keefer L. K. et al., Cancer Research, vol. 27, p. 110, 1986.
DeRubertis F. et al., Science, vol. 193, pp. 897–899, 1976.
Arnold W. P. et al., Science, vol. 198, pp. 934–936, 1977.
Murad F. et al., Advances in Cyclic Nucleotied Research, vol. II, pp. 175–204, 1979.

*Primary Examiner*—V. Millin
*Attorney, Agent, or Firm*—Lilling and Lilling

[57] ABSTRACT

The invention consists of a method for absorbing nitrogen oxide and carbon monoxide from tobacco smoke. It includes a base made of acetate, cellulose and acetate-cellulose fibers. The base is impregnated with an absorbing agent, and the absorbing agent may include a complex compound of ferrous iron and thiol-containing low-molecular ligands. A method for impregnating the base of the filter with the absorbing agent comprises immersing the base in an aqueous suspension of a complex compound of ferrous iron and thiol-containing low-molecular ligands and then drying it; or, treating the base with an aqueous solution of a thiol-containing low-molecular ligand, treating the resulting compound with an aqueous solution of ferrous salts and then drying the resulting compound. A composition for absorbing nitrogen oxide and carbon monoxide from smoke comprises a complex compound of ferrous iron and thiol-containing low-molecular ligands. A method of removing nitrogen oxide and carbon monoxide from smoke consists of passing the smoke through an absorbing agent consisting of a complex compound of ferrous iron and thiol-containing low-molecular ligands.

14 Claims, 1 Drawing Sheet

COMPOSITION FOR ABSORBING NITROGEN OXIDE FROM TOBACCO SMOKE, METHOD FOR ABSORBING NITROGEN OXIDE USING SAID COMPOSITION, FILTER FOR PURIFYING TOBACCO SMOKE USING SAID COMPOSITION, AND METHOD FOR IMPREGNATING THE BASE OF A FILTER WITH SAID COMPOSITION

FIELD OF THE INVENTION

The present invention relates to techniques for purifying smoke of nitrogen oxide and, more specifically, to a filter for purifying tobacco smoke of nitrogen oxide. The filter can be used in the tobacco industry in manufacturing filter cigarettes.

DESCRIPTION OF THE PRIOR ART

It is common knowledge that aside from nicotine and other toxic products, tobacco smoke contains carbon monoxide (CO) and nitrogen oxide (NO), which have a harmful effect on human organism. Known in the art is a cigarette filter (ref. British Patent No. 2,150,806, published on July 10, 1985, Filtrona Limited—Applicant, and entitled Tobacco Smoke Filter) comprising a base of acetate, cellulose or acetate-cellulose fibers bonded to absorbing means. The absorbing means is a complex compound of the transition metal group and ligands of the oxime series deposited on granules of an inert base, for example, pumice, silica gel, magnesium silicate, etc. These compounds are relatively stable in the air, but are activated upon contact with tobacco smoke and then bind nitrogen oxide and/or carbon monoxide and in this way remove them from the smoke. As a result, mononitrosyl and monocarbonyl complexes of the transition metal group with oximes are formed.

In the existing tobacco filters, only a portion of the gases is absorbed. In particular, the filter disclosed in the above mentioned British Patent No. 2,150,806 absorbs not more than 10% of CO and NO because of the insufficiently high affinity of the complex metal compounds and oximes with nitrogen oxide and carbon monoxide, insufficient contact between tobacco smoke and these complex compounds because they are introduced into the filter by deposition on granules, and the need for pre-reducing these compounds with tobacco smoke components.

In addition to oximes, the transition group metals can bind ligands of a different nature to produce complexes which are also capable of absorbing nitrogen oxide and carbon monoxide. Most effective for this purpose is a complexe of iron with dithiol-containing ligands (ref. article by A.F. Mordvintsev P.I. and Kleshchev A.L., in "Stadia Biophysica", 1984, Vol. 102, p. 135).

Such complexes may develop, for example, in tissues of animal organs, for example, during intraabdominal injection of diethyldithiocarbamate (DETC) to mice. In this case, DETC forms a metal complex with endogenous iron which accepts the NO merging in the organ tissues.

SUMMARY OF THE INVENTION

The present invention is aimed at raising the degree of purification of tobacco smoke of nitrogen oxide.

This aim is achieved by a composition for absorbing nitrogen oxide from tobacco smoke, which is constituted by complex compounds of transition group metals with ligands. According to the invention, ferrous iron is used as the transition group metal and as the ligands are thiol-containing low-molecular compounds, the ratio of iron ions to the number of ligand molecules not exceeding 1:2.

The claimed composition ensures a higher degree of absorbtion of nitrogen oxide from tobacco smoke due to the fact that ferrous complexes with thiol-containing low-molecular ligands have a higher affinity to nitrogen oxide as compared with similar complexes with oximes.

It is preferred that the claimed composition should comprise a complex compound of ferrous iron and monothiol-containing low molecular ligands.

Optionally, the claimed composition may comprise a complex compound of ferrous iron and dithiol-containing organic low-molecular ligands.

It is also possible that, as the claimed composition, use be made of a complex compound of ferrous iron and diethyldithiocarbamate.

The above-mentioned aim is further achieved by providing a method for absorbing nitrogen oxide from tobacco smoke by causing the tobacco smoke to pass through said absorbing composition. According to the invention, the method consists of simultaneous disolution of the above-mentioned complex compound by substances contained in the tobacco smoke in order to bind the nitrogen oxide.

The claimed method makes it possible to enhance the degree of absorption of nitrogem oxide from the tobacco smoke due to the use of the above-mentioned composition and due to the fact that there is no need to carry out reduction of iron, since the activation of the above-mentioned complex compounds is achieved by dissolving them by the substances present in the tobacco smoke.

The above described aim is also achieved by a filter for purifying tobacco smoke comprising a base of acetate, cellulose or acetate-cellulose fibers and an absorbing means constituted by the said absorbing composition, wherein the base is impregnated by the absorbing composition.

The claimed filter insures removal of up to 80 percent of nitrogen oxide from tobacco smoke due to the fact that use of the absorbing agent and due to a more effective contact of the absorbing agent with the tobacco smoke due to the impregnation of the filter base with the absorbing agent.

It is preferable that the content of the absorbing agent be at least three percent of the total weight of the filter. This proportion ensures the most efficient retention of nitrogen oxide.

It is preferable that the absorbing agent should comprise a complex compound of ferrous iron and a monothiol-containing low-molecular ligand.

Optionally, it is also possible to use as the absorbing agent a complex compound of ferrous iron and a dithiol-containing organic low-molecular ligand.

This makes it possible to prolong the filter quality for a longer time, since such complexes are not affected by moisture.

It is also possible that, as the absorbing agent use may be made of a complex compound of ferrous iron and diethyldithiocarbamate.

It is also preferable that the concentration of ferrous iron be equal to 0.3 to 1%, and that of the thiol-containing low-molecular ligand be equal to 1 to 5% of the total weight of the filter.

It is preferable that the content of the absorbing agent be equal to from 3 to 13% of the total weight of the filter.

The above-mentioned aim is further achieved due to the fact that the method of impregnating the base of a filter for purifying tobacco smoke of nitrogen oxide, made of acetate, cellulose or acetate-cellulose fibers, according to the invention, consists in immersing said base in an aqueous suspension or solution of a complex compound of ferrous iron and thiol-containing low-molecular ligands, and then drying the base.

The above aim can also be attained by a method of impregnating the base of a filter for purifying tobacco smoke of nitrogen oxide, made of acetate, cellulose or acetate-cellulose fibers, according to the invention, comprising the following successive steps:

treating said base with an aqueous solution of a thiol-containing low-molecular ligand;

drying the thus treated base;

treating the resulting dried base with an aqueous solution of ferrous iron; and drying the resultant base.

This procedure gives the filter a higher stability to mechanical forces (shaking, vibration, etc.) due to the more pronounced fine dispersion of the powdered complex compound of ferrous iron and dithiol-containing low-molecular organic ligands and, therefore, a firmer bond between it and the filter base.

DETAILED DESCRIPTION OF THE INVENTION

Figure 1:
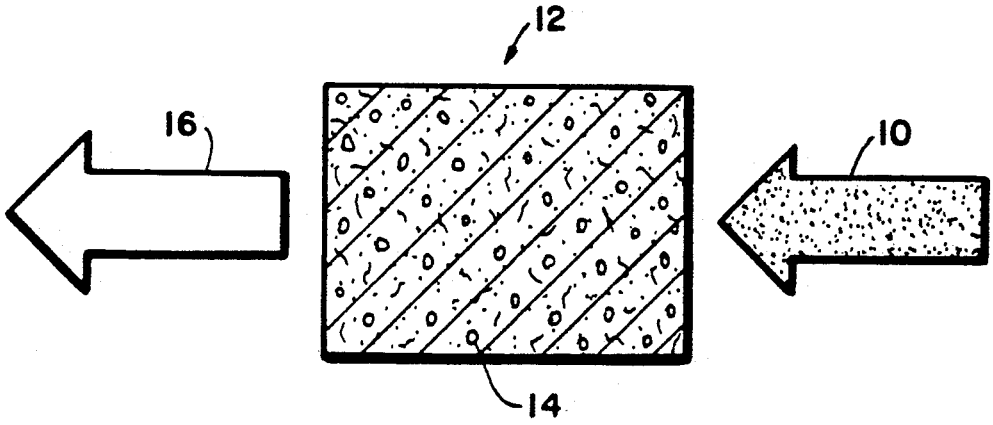

The invention is subsequently explained with reference to examples illustrating its specific embodiments.

The composition for absorbing nitrogen oxide from tobacco smoke comprises a complex compound of ferrous iron and a thiol-containing low-molecular ligand, the ratio of iron ions to the number of ligand molecules being not more than 1:2.

With a ratio of iron ions to the number of ligand molecules more than 1:2, the number of said complexes decreases because of a deficiency in iron ions, thereby adversely affecting the capacity of the filter to absorb nitrogen oxide.

As the composition, use can be made of a complex compound of ferrous iron and a monothiol-containing low-molecular ligand or a dithiol-containing low-molecular organic ligand.

The monothiol-containing compounds may represent, for example, sodium thiolsulfate ($Na_2S_2O_2$), cysteine, reduced glutathione, and others).

The dithiol-containing organic compounds may be represented by, for example, diethyldithiocarbamate (DETC), dimethyldithiocarbamate (DMTC), sodium ethyl xanthogenate, and others.

The sources for producing ferrous iron may include iron salts, for example $FeSO_4$, $FeCl_2$, $FE(NO_3)_2$, etc.

The following reaction between ferrous iron and dithiol-containing low-molecular ligands produces water-insoluble, oxidation-resistant single crystals of complexes, which do not disintegrate upon storage and are agents absorbing the nitrogen oxide from tobacco smoke:

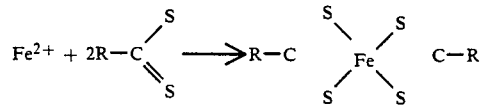

(I)

wherein R is $N(C_2H_5)_2$, $N(CH_3)_2$, $C_2H_5O$ and $CH_3O$.

The claimed method for absorbing nitrogen oxide from tobacco smoke resides in causing the tobacco smoke to pass through a complex compound, as a result of which the complex compound becomes dissolved with substances contained in the tobacco smoke, such as, for example, water, turpentine, acetone.

Nitrogen oxide is absorbed by such complexes according to the following reaction:

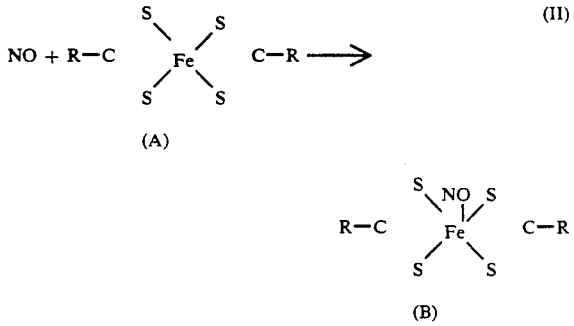

(II)

When the ligands are represented by monothiol-containing compounds (L), nitrogen oxide is absorbed from the tobacco smoke according to the reaction:

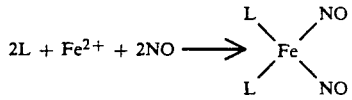

BRIEF AND DETAILED DESCRIPTION OF THE SOLE FIGURE

The claimed filter 2 for purifying tobacco smoke 10 of nitrogen oxide comprises a base made of acetate, cellulose or acetate fibers impregnated with an absorbing agent 14, which is constituted by the above-described composition for absorbing nitrogen. After the tobacco smoke 10 passes through the base 12 impregnated with the absorbing agent 14, the resulting air 16 is cleaned of impurities.

The method of impregnating the base of a filter for purifying tobacco smoke from nitrogen oxide is carried out by immersing it in an aqueous suspension or solution of a complex compound of ferrous iron and thiol-containing low-molecular ligands and subsequently drying it. (In the table that follows, this method is designated by the reference numeral 1.)

When the ligands are dithiol-containing low-molecular organic compounds, it is preferred, in order to increase the strength of the bond between the filter base and the complexes of ferrous iron and these ligands, to impregnate the filter base as follows:

The base of acetate, cellulose or acetate-cellulose fibers is treated with an aqueous solution of a thiol-containing low-molecular ligand, then dried, the resulting compound is then treated with an aqueous solution of a ferrous iron salt and then dried. (In the table that follows, this method is designated by the reference numeral 2.)

Following below are specific examples illustrating the process of preparing said composition and said filter.

EXAMPLE 1

There are prepared two aqueous solutions, namely, an aqueous solution containing 0.6% of FeSO4 and an aqueous solution containing 2% of DETC. Both solutions are poured together in equal volumes. As a result, the FeSo4 concentration becomes equal to 0.3%, and that of DETC—to 1%, which is tantamount to a ratio of iron ions to the number of DETC molecules equal to 1:5. Upon mixing and subjecting to the above-described reaction (I), a complex A is formed in the solution in the form of a finely dispersed precipitate. The aqueous suspension thus-prepared is taken in an amount of at least 5 ml and used to impregnate for 60 sec. the base of filter made of acetate fibres in the form of a cylinder having a diameter of 7.9 mm, a length of 15 mm and a weight of 110 mg. The amount of complexes A (ref. Formula II) penetrating from the suspension into the filter base accounts for 3.6% of the filter weight. The resulting filter base is then dried at room temperature for 48 hours. The resulting filter ensures an 80% purification of tobacco smoke of nitrogen oxide.

EXAMPLE 2

There are prepared an aqueous solution containing 10% of FeSO4, and an aqueous solution containing 5.5% of DETC. Both solutions are mixed together in a ratio of 1:10 respectively. As a result, the FeSO4 concentration becomes equal to 1%, while that of DETC—to 5%, which corresponds to a ratio of iron ions to the number of DETC molecules equal to 1:8. The aqueous suspension thus-prepared is taken in an amount of at least 5 ml to treat a filter base made of acetate fibres in the form of a cylinder having a diameter of 7.9 mm, a length of 15 mm, and a weight of 110 mg. The amount of complexes A which have passed from the suspension into the filter base accounts for 13% of the filter weight. The resulting base is then dried at room temperature for 48 hours. The filter ensures an 80% purification of tobacco smoke of nitrogen oxide (NO).

EXAMPLE 3

There are prepared an aqueous solution containing 0.2% of FeSO4 and an aqueous solution containing 2% of DETC. Both solutions are mixed together in equal volumes. As a result, the FeSO4 concentration becomes equal to 0.1%, and that of DETC—to 1%, which corresponds to a ratio of iron ions to the number of DETC molecules equal to 1:16.

A filter base made of acetate fibres and shaped as a cylinder having a diameter of 7.9 mm, a length of 15 mm, and a weight of 110 mg is treated with the aqueous suspension thus-prepared taken in an amount of at least 5 ml. The amount of complexes A which have passed from the suspension into the filter base accounts for 1.3% of the filter weight. The filter base thus-obtained is then dried at room temperature for 48 hours. The resulting filter ensures a 15% purification of tobacco smoke of nitrogen oxide (NO).

EXAMPLE 4

There is prepared an aqueous solution containing 0.3% of FeSO4 and 1% of sodium thiosulphate (Na2S2O3), which corresponds to a ratio of iron ions to the number of Na2S2O3 molecules equal to 1:5. The solution thus-prepared taken in an amount of at least 5 ml is used to treat a filter base made of acetate fibres and shaped as a cylinder having a diameter of 7.9 mm, a length of 15 mm, and a weight of 110 mg. The filter base thus-treated is then dried at room temperature for 48 hours. The resulting filter ensures an 80% purification of tobacco smoke of nitrogen oxide (NO).

EXAMPLE 5

An aqueous solution containing 2% of DETC and taken in an amount of at least 5 ml has been used to impregnate for 60 sec. a filter base made of acetate fibres and shaped as a cylinder having a diameter of 7.9 mm, a length of 15 mm, and a weight of 110 mg. Thereafter, the filter base has been dried at room temperature for 48 hours and then impregnated with an aqueous solution containing 0.5% of FeSO4 and taken in an amount of at least 5 ml. Finally, the filter base has been dried at room temperature for 48 hours. At this, the ratio of iron ions to the number of DETC molecules is equal to 1:7, and the amount of complexes A formed in the filter base accounts for 7% of the filter weight. The resulting filter ensures an 80% purification of tobacco smoke of nitrogen oxide (NO).

EXAMPLE 6

There are prepared an aqueous solution containing 1% of FeSO4, and an aqueous solution containing 4% of DETC. Both solutions are mixed together in equal volumes. As a result of mixing, the FeSO4 concentration becomes equal to 0.5%, while that of DETC—to 2%, which is equivalent to a ratio of iron ions to the number of DETC molecules equal to 1:7. The aqueous suspension thus-prepared taken in an amount of at least 5 ml is used to impregnate for 60 sec. a filter base identical to that described in Example 1 hereinabove. The amount of complexes A which have passed from the suspension into the filter base accounts for 7% of the filter weight. The resulting filter ensures an 80% purification of tobacco smoke of nitrogen oxide.

EXAMPLE 7

The procedure used for impregnating a filter base is identical to that described in Example 5. As a ferrous iron salt, use is made of FeCl2. The FeCl2 and DETC contents in aqueous solutions are equal to 1% and 5%, which corresponds to a ratio of iron ions to the number of DETC molecules equal to 1:8. The amount of complexes A formed within the filter base accounts for 13% of the filter weight. The resulting filter ensures an 80% purification of tobacco smoke of nitrogen oxide (NO).

EXAMPLE 8

There are prepared an aqueous solution containing 1% of Fe(NO3)2, and an aqueous solution containing 4% of DETC. Both solutions are mixed together in equal volumes. As a result, the Fe(NO3)2 concentration becomes equal to 0.5%, while that of DETC—to 2%, which corresponds to a ratio of iron ions to the number of DETC molecules equal to 1:7. The aqueous suspension thus-prepared is taken in an amount of at least 5 ml and used to impregnate for 60 sec. a filter base identical to that of Example 1. The amount of complexes A which have passed from the suspension into the filter base accounts for 7% of the filter base. The resulting filter ensures an 80% purification of tobacco smoke of nitrogen oxide (NO).

EXAMPLE 9

The procedure used for impregnating a filter base is identical to that used in Example 5. As a ferrous iron salt, use is made of Fe(NO3)2. The Fe(NO3)2 and DETC contents in aqueous solutions are equal to 0.5% and 2%, respectively, which is tantamount to a ratio of iron ions to the number of DETC molecules equal to 1:7. The amount of complexes A which are formed within the filter base accounts for 7% of the filter weight. The resulting filter ensures an 80% purification of tobacco smoke of nitrogen oxide (NO).

EXAMPLE 10

The procedure used for impregnating a filter base is identical to that of Example 5. As an alkyl derivative of sodium carbamate, use is made of DMTC. The FeSO4 and DMTC contents in aqueous solutions are equal to 0.5% and to 2%, respectively, which corresponds to a ratio of iron ions to the number of DMTC molecules equal to 1:7. The amount of complexes A formed within the filter base accounts for 7% of the filter weight. The resulting filter ensures an 80% purification of tobacco smoke of nitrogen oxide (NO).

EXAMPLE 11

There are prepared an aqueous solution containing 2% of FeSO4, and an aqueous solution containing 2.4% of DETC. Both solutions are mixed together in equal volumes. As a result of mixing, the FeSO4 concentration becomes equal to 1%, while that of DETC—to 1.2%, which corresponds to a ratio of iron ions to the number of DETC molecules equal to 1:2. The aqueous suspension thus-prepared is used to impregnate for 60 sec. a filter base identical to that of Example 1. The amount of complexes A which have passed from the suspension into the filter base accounts for 3% of the filter weight. The resulting filter ensures an 80% purification of tobacco smoke of nitrogen oxide (NO).

EXAMPLE 12

The procedure used for impregnating a filter base is identical to that used in Example 5. Use is made of a filter base formed by cellulose fibres. The amount of complexes A formed within the filter base is equal to 7% of the filter weight. The resulting filter ensures an 80% purification of tobacco smoke of nitrogen oxide (NO).

EXAMPLE 13

The procedure used for impregnating a filter base is identical to that used in Example 5. A filter base made of acetate-cellulose fibres is used. The amount of complexes A formed within the filter base accounts for 7% of the filter weight. The resulting filter ensures an 80% purification of tobacco smoke of nitrogen oxide (NO).

The results of the Examples, presented in Table 1, show that the optimal conditions to obtain a high purification degree of tobacco smoke of nitrogen oxide are attained at a concentration of ferrous salt and alkyl derivative of sodium carbamate in the impregnation solution ranging from 0.3 to 1% and from 1 to 5%, respectively, which corresponds to the amount of iron complexes with alkyl derivates of sodium carbamate in the filter within 3.0 to 13%. It is unjustified to raise the concentration of complexes of ferrous iron and alkyl derivative of sodium carbamate above 13%, because this would not raise the purification degree of tobacco some of nitrogen oxide, but would obstruct the passage of the smoke through the filter. Storage of filters for 365 days prior to testing does not affect the absorbing properties of the filters, which is an important advantage for industrial production. The results of the experiments indicate that the claimed cigarette filter raises the purification of tobacco smoke of nitrogen oxide to 80%. and, at the same time, the purification of the smoke from carbon monoxide is about 10%.

Considering the smokers' preference for white-filter cigarettes, it is possible to manufacture cigarettes having a combined filter consisting of two parts, the first part located at the side of tobacco being a filter manufactured according to the present invention, and the second part being made of acetate, cellulose and acetate-cellulose fibers used in the tobacco industry and attached to the first part at the opposite side from the tobacco.

TABLE 1

| Complex components | Concentration Impregnating Solutions, % | Concentration Complexes A Filter, % | Filter treatment Method | Purif. Tobacco Smoke NO Filter, % | Storage Time Prior to Test |
|---|---|---|---|---|---|
| 1. $FeSO_4$ | 0.3 | 3.6 | 1 | 80 | 1;365 |
| DETC | 1.0 | | | | |
| 2. $FeSO_4$ | 1.0 | 13 | 1 | 80 | 1;365 |
| DETC | 5.0 | | | | |
| 3. $FeSO_4$ | 0.1 | 1.3 | 1 | 15 | 1 |
| DETC | 1.0 | | | | |
| 4. $FeSO_4$ | 0.3 | 3.6 | 1 | 80 | 1 |
| $Na_2S_2O_3$ | 1.0 | | | | |
| 5. $FeSO_4$ | 0.5 | 7 | 2 | 80 | 1;365 |
| DETC | 2.0 | | | | |
| 6. $FeSO_4$ | 0.5 | 7 | 1 | 80 | 1;365 |
| DETC | 2.0 | | | | |
| 7. $FeCl_2$ | 1.0 | 13 | 2 | 80 | 1;365 |
| DETC | 5.0 | | | | |
| 8. $Fe(NO_e)_2$ | 0.5 | 7 | 1 | 80 | 1;365 |
| DETC | 2.0 | | | | |
| 9. $Fe(NO_3)_2$ | 0.5 | 7 | 2 | 80 | 1;365 |
| DETC | 2.0 | | | | |
| 10. $FeSO_4$ | 0.5 | 7 | 2 | 80 | 1;365 |
| DMTC | 2.0 | | | | |
| 11. $FeSO_4$ | 1.0 | 3 | 1 | 80 | 1 |
| DETC | 1.2 | | | | |

TABLE 1-continued

| Complex components | Concentration Impregnating Solutions, % | Concentration Complexes A Filter, % | Filter treatment Method | Purif. Tobacco Smoke NO Filter, % | Storage Time Prior to Test |
|---|---|---|---|---|---|
| 12. $FeSO_4$ | 0.5 | 7 | 2 | 80 | 1;365 |
| DETC | 2.0 | | | | |
| 13. $FeSO_4$ | 0.5 | 7 | 2 | 80 | 1;365 |
| DETC | 2.0 | | | | |

We claim:

1. A filter for purifying tobacco smoke of nitrogen oxide, comprising a base made of acetate, cellulose or acetate cellulose fibers and impregnated with an absorbing agent which is a complex compound of ferrous iron and thiol-containing low-molecular ligand at a ratio of iron ions to the number of ligand molecules of not more than 1:2.

2. A filter according to claim 1, wherein the proportion of said absorbing agent is at least 3% of the total weight of the filter.

3. A filter according to claim 1, wherein said absorbing agent is a complex compound of ferrous iron and a monothiol-containing low-molecular ligand.

4. A filter according to claim 1, wherein said absorbing agent is a complex compound of ferrous iron and a dithiol-containing low-molecular ligand.

5. A filter according to claim 4, wherein said absorbing agent is a complex compound of ferrous iron and diethyldithiolcarbamate.

6. A filter according to claim 1, wherein the concentration of the ferrous iron is from 0.3–1% and the concentration of the thiol-containing low-molecular ligand is from 1–5%.

7. A filter according to claim 2, wherein the proportion of said absorbing agent is between 3 and 13% of the total weight of the filter.

8. A method of impregnating the base of a filter for purifying tobacco smoke from nitrogen oxide, made of acetate, cellulose or acetate-cellulose fibers, comprising treatment of said filter base with an aqueous suspension or an aqueous solution of a complex compound of ferrous iron and thiol-containing low-molecular ligand, followed by drying it.

9. A method of impregnating the base of a filter for purifying tobacco smoke from nitrogen oxide, made of acetate, cellulose or acetate-cellulose fibers, comprising the following sequential steps of: treating said filter base with an aqueous solution of a thiol-containing low-molecular ligand; drying the filter base thus-treated; treating the dried filter base with an aqueous solution of ferrous salt; and drying the resulting filter base.

10. A composition for absorbing nitrogen oxide from tobacco smoke, comprising a complex compound of ferrous iron and a thiol-containing low-molecular ligand at a ratio of iron ions to the number of ligand molecules of not more than 1:2.

11. A composition according to claim 10, wherein said composition is a complex compound of ferrous iron and a monothiol-containing low-molecular ligand.

12. A composition according to claim 10, wherein said composition is a complex compound of ferrous iron and a dithiol-containing low-molecular ligand.

13. A composition according to claim 12, wherein said composition is a complex compound of ferrous iron and diethyldithiolcarbamate.

14. A method for absorbing nitrogen oxide from tobacco smoke, comprising the steps of: passing the tobacco smoke through an absorbing composition consisting of a complex compound of ferrous ion and a thiol-containing low-molecular ligand at a ratio of iron ions to the number of ligand molecules of not more than 1:2; simultaneously dissolving said complex compound by substances contained in the tobacco smoke to bind nitrogen oxide by said complex compound.

* * * * *